US006895208B2

(12) United States Patent
Nakatogawa et al.

(10) Patent No.: US 6,895,208 B2
(45) Date of Patent: May 17, 2005

(54) SLIDING MEMBER FOR ELECTROPHOTOGRAPHIC APPARATUS AND FIXING DEVICE USING THE SAME

(75) Inventors: Kenji Nakatogawa, Minamiashigara (JP); Yousuke Tsutsumi, Minamiashigara (JP); Jun Kimura, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/626,566

(22) Filed: Jul. 25, 2003

(65) Prior Publication Data

US 2004/0131401 A1 Jul. 8, 2004

(30) Foreign Application Priority Data

Dec. 12, 2002 (JP) ..... 2002-360835

(51) Int. Cl.[7] ..... G03G 15/20
(52) U.S. Cl. ..... 399/329; 428/422
(58) Field of Search ..... 399/320, 328, 399/329, 330, 331, 333; 219/216; 428/696, 35.7, 36.92, 409, 421, 422; 427/533; 204/157.63, 157.8

(56) References Cited

U.S. PATENT DOCUMENTS

| | | | | | |
|---|---|---|---|---|---|
| 3,884,868 | A | * | 5/1975 | Trice et al. | 524/413 |
| 4,359,963 | A | * | 11/1982 | Saito et al. | 118/60 |
| 4,518,737 | A | * | 5/1985 | Traut | 524/413 |
| 4,796,046 | A | * | 1/1989 | Suzuki et al. | 399/331 |
| 6,486,441 | B1 | * | 11/2002 | Chen et al. | 219/216 |

FOREIGN PATENT DOCUMENTS

| | | | | |
|---|---|---|---|---|
| JP | 62270985 | A * | 11/1987 | G03G/15/20 |
| JP | A 10-213984 | | 8/1998 | |
| JP | A 2001-249558 | | 9/2001 | |

* cited by examiner

*Primary Examiner*—Robert Beatty
(74) *Attorney, Agent, or Firm*—Oliff & Berridge, PLC

(57) ABSTRACT

The present invention relates to a sliding member for an electrophotographic apparatus using a non-porous sheet having a sliding surface including at least a fluorocarbon resin as a sheet-like member interposed between a press member A and a resin film tubular body. The invention also relates to an image fixing device using the sliding member.

16 Claims, 1 Drawing Sheet

SLIDING MEMBER FOR ELECTROPHOTOGRAPHIC APPARATUS AND FIXING DEVICE USING THE SAME

CROSS-REFERENCE TO RELATED APPLICATION

This application claims priority under 35USC 119 from Japanese Patent Application No. 2002-360835, the disclosure of which is incorporated by reference herein.

BACKGROUND OF THE INVENTION

1. Field of the Invention

The present invention relates to a fixing device used for heating and pressurizing an unfixed image to be fixed in an image forming apparatus such as a copier, a printer, or a facsimile, and particularly, to a sliding member (a sheet-like member) for an electrophotographic apparatus interposed between a press member which presses a tubular body for fixing, from inside of the tubular body toward a fixing member side, in order to form a nip portion through which a recording medium passes, and the tubular body; and a fixing device using the sliding member.

2. Description of the Related Art

In forming an electrophotographic image by a printer, a copier, a facsimile or the like, it is necessary for a recording sheet or the like on which an unfixed toner image is formed, to be heated and pressurized for fixing the toner image by passing through an image fixing device. A belt nip scheme has been publicly known in which a film tubular body made of heat resistant plastic is used as the image fixing device. In the belt nip scheme, the film tubular body is circumscribed about a driving fixing roll, an elastic press member is inscribed inside of the film tubular body in the circumscribed portion, a sliding sheet is provided between them and oil is applied on the sliding sheet, whereby a nip portion is formed between the fixing roll and the film tubular body and the toner image is fixed on the recording sheet while the recording sheet passes through the nip portion.

In the nip belt scheme, it is inevitable to prevent slippage between the fixing roll and the recording sheet, and slippage between the recording sheet and the film tubular body in order to ensure an excellent fixed image and fixing property. Hence, if a friction coefficient between the fixing roll and the recording sheet is denoted by $\mu a$, a friction coefficient between the recording sheet and the film tubular body is denoted by $\mu b$ and a friction coefficient between the film tubular body and the elastic press member is denoted by $\mu c$, it is at least required to satisfy both of the relations, $\mu a > \mu c$ and $\mu b > \mu c$. Conventionally, in order to reduce the friction coefficient $\mu c$, there have been made proposals in which the elastic press member is covered with a covering layer (a low friction sheet) made of a glass fiber sheet which has been coated with fluorocarbon resin and baked, and one of various kinds of modified silicone oils as a lubricant is placed between the covering layer and the film tubular body (for example, Japanese Patent Application Laid-Open (JP-A) Nos. 10-213984 and 2001-249558).

Such a conventionally used covering layer (low friction sheet) made of a glass fiber sheet which has been coated with fluorocarbon resin and baked, has a porous surface at least on the face in sliding contact to the inner surface of the film tubular body, in order to retain a lubricant thereon. However, it has been found that since the sliding surface of the low friction sheet is porous, problems still remain due to insufficiency with respect to the following aspects.

That is, in the usage over a long term, a fluorocarbon resin layer coated on the outermost surface of the covering layer is worn out to expose a glass fiber sheet serving as a reinforcing substrate. And the inner surface of the belt is worn out by the contact with the glass fiber, which deteriorates reliability of the belt. Further, worn-out powders are accumulated, and there arises an occasion in which and the glass fiber surface directly contacts with the inner surface of the belt to increase a friction coefficient between the inner surface of the film tubular body (an endless belt) and a surface of the low friction sheet. It in turn increase a driving torque for the fixing roll. As a result, a stress increases that acts on a gear receiving section with a small thickness of a fixing roll core, causing breakage of the gear and the core. Furthermore, as a matter of course, it increases a load on a motor.

SUMMARY OF THE INVENTION

It is accordingly a theme of the present invention to solve the conventional problems described above and achieve the following object. That is, it is an object of the invention to provide a sliding member for an electrophotographic apparatus having high heat resistant stability capable of enduring the usage thereof over a long term; and an image fixing device for realizing stable running of a film tubular body (a belt) using the sliding member.

The inventors have conducted an intensive study on characteristics (including a strength, an elasticity, a plasticity, a low friction characteristics, a heat resistance, a thermal conductivity, a reactivity, geometrical characteristics, a filler particle size, a shape of a filler particle, an amount of a filler to be added, a kind of filler and the like) of materials of a sliding member by focusing attention on improvement on reliability of the sliding member in order to achieve the above object. And the inventors have found that a reliability in the usage over a long term of the sliding member is improved by forming a sliding surface with a non-porous fluorocarbon resin layer and in addition, adding a filler to the layer, which has led to completion of the invention. The above theme is solved by the following means, that is:

The first aspect of the invention is to provide a sliding member (S) for an electrophotographic apparatus, in which at least a sliding surface thereof is made of a non-porous sheet including a fluorocarbon resin.

The second aspect of the invention is to provide a sliding member for an electrophotographic apparatus (S), wherein a surface roughness depth Rt of the sliding surface is in a range of 1.0 $\mu$m to 50.0 $\mu$m.

The third aspect of the invention is to provide a sliding member for an electrophotographic apparatus (S), wherein the fluorocarbon resin is selected from the group consisting of polytetrafluoroethylene (PTFE), perfluoroalkoxy resin (PFA), and modified resins thereof.

The fourth aspect of the invention is to provide a sliding member for an electrophotograhic apparatus (S), wherein the fluorocarbon resin is a modified polytetrafluoroethylene resin (PTFE) obtained by irradiating a fluorocarbon resin with ionizing radiation.

The fifth aspect of the invention is to provide a sliding member for an electrophotograhic apparatus (S), wherein a filler is contained in the non-porous sheet.

The sixth aspect of the invention is to provide a sliding member for an electrophotograhic apparatus (S), wherein a surface roughness depth Rt of the sliding surface is in a range of 1.0 $\mu$m to 50.0 $\mu$m, and a filler is contained in the non-porous sheet.

The seventh aspect of the invention is to provide a sliding member for an electrophotograhic apparatus (S), wherein the fluorocarbon resin is selected from the group consisting of polytetrafluoroethylene (PTFE), perfluoroalkoxy resin (PFA), and modified resins thereof, and a filler is contained in the non-porous sheet.

The eighth aspect of the invention is to provide a sliding member for an electrophotograhic apparatus (S), wherein the fluorocarbon resin is a modified polytetrafluoroethylene resin (PTFE) obtained by irradiating a fluorocarbon resin with ionizing radiation, and a filler is contained in the non-porous sheet.

The ninth aspect of the invention is to provide a sliding member for an electrophotographic apparatus (S), wherein a filler is contained in the non-porous sheet, and the filler is a lubricative filler having a layered structure.

The tenth aspect of the invention is to provide a sliding member for an electrophotographic apparatus (S), wherein a filler is contained in the non-porous sheet, and the filler is a conductive filler.

The eleventh aspect of the invention is to provide a sliding member for an electrophotographic apparatus (S), wherein a filler is contained in the non-porous sheet, and the filler includes a heat resistant resin selected from the group consisting of an imide-type resin, an amide-type resin and an aromatic polyester-type resin.

The twelfth aspect of the invention is to provide a sliding member for an electrophotographic apparatus (S), wherein a filler is contained in the non-porous sheet, and the filler is a reinforcing filler having a needle-shaped, fiber-shaped or tetrapod-shaped structure.

The thirteenth aspect of the invention is to provide a sliding member for an electrophotographic apparatus (S), wherein a filler is contained in the non-porous sheet, and the filler includes at least two kinds of fillers.

The fourteenth aspect of the invention is to provide a sliding member for an electrophotographic apparatus (S), wherein a filler is contained in the non-porous sheet, and an amount of the filler to be added is in a range of 1.0 part by mass to 30 parts by mass with respect to 100 parts by mass of the fluorocarbon resin.

The fifteenth aspect of the invention is to provide a sliding member for an electrophotographic apparatus (S), wherein the non-porous sheet is provided on a substrate which has depressions and protrusions on a surface thereof.

The sixteenth aspect of the invention is to provide a fixing device (T) comprising:

a driving member;

a tubular body for fixing, which is pressed to the driving member so that the tubular body can be driven to rotate by the driving member, a recording medium on which an unfixed toner image is formed being sandwiched between the tubular body and the driving member at a nip portion formed between the tubular body and the driving member, a press member disposed inside the tubular body that presses the tubular body toward the driving member;

a sheet-shaped member interposed between the tubular body and the press member;

a lubricant provided between the tubular body and the sheet-like member; and a heat source for heating the nip portion, wherein the sheet-shaped member is a sliding member for an electrophotographic apparatus in which at least a sliding surface of the sliding member is made of a non-porous sheet including a fluorocarbon resin.

The seventeenth aspect of the invention is to provide a fixing device (T), wherein the lubricant is selected from the group consisting of a synthetic lubricating oil grease, a dimethylsilicone oil, dimethylsilicone oil to which an organic metal salt is added, dimethylsilicone oil to which a hindered amine is added, dimethylsilicone oil to which an organic metal salt and hindered amine are added, a methylphenylsilicone oil, amino-modified silicone oil to which an organic metal salt is added, amino-modified silicone oil to which a hindered amine is added, a perfluoropolyether oil and a modified perfluoropolyether oil.

A sliding member for an electrophotographic apparatus of the invention is made of a non-porous sheet having a sliding surface (a surface put into contact with the inner surface of the tubular body for fixing) including a fluorocarbon resin, the interior of the sliding member (the interior of the sheet) is not impregnated with a lubricant, and the lubricant is retained on the sliding surface by a geometric shape and a chemical affinity of the surface to thereby reduce a friction with the inner surface of the tubular body for fixing. Hence, it becomes possible to provide a sliding member having high heat resistant stability capable of enduring the usage over a long term. No chemical change in property occurs that is caused by surface swelling under an influence of a lubricant; thereby enabling prevention of an image defect such as irregularity of a fixed image caused by a variation in the shape of a nip.

DETAILED DESCRIPTION OF THE INVENTION

Figure 1:
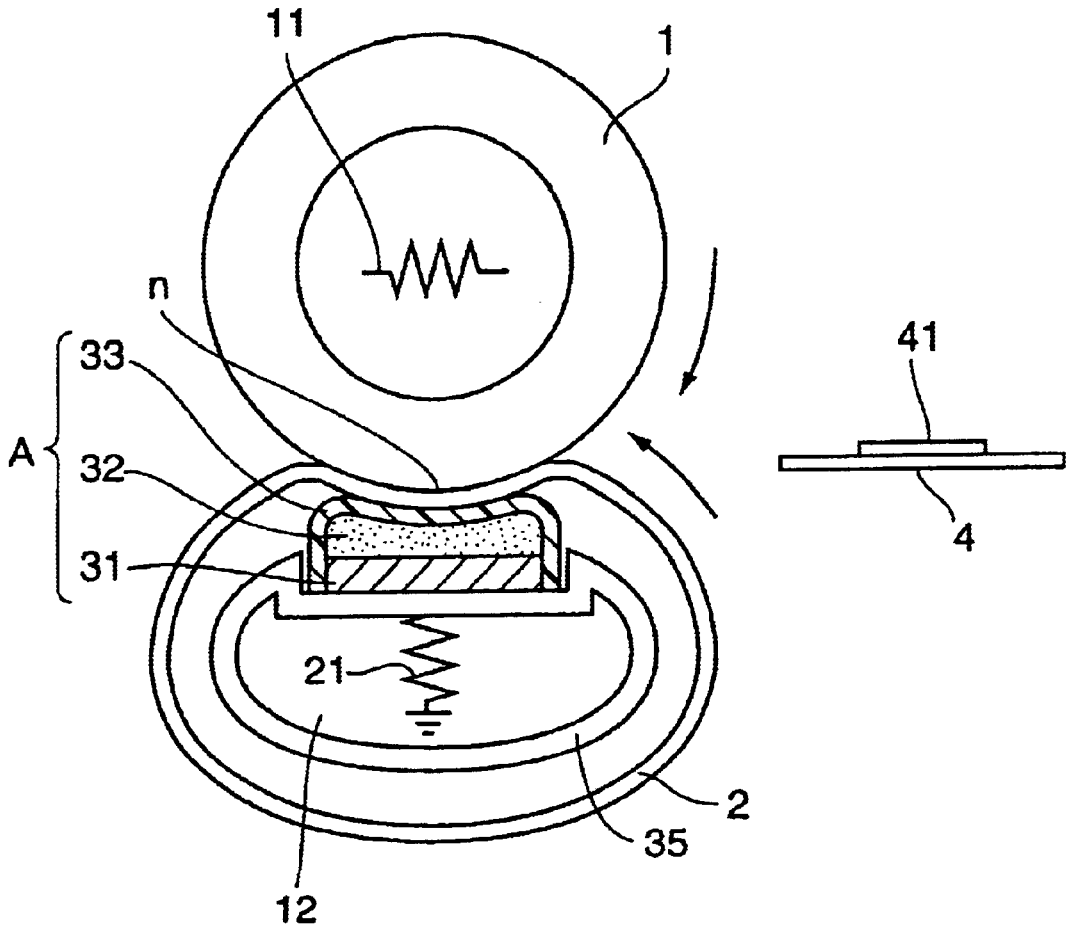
FIG. 1 is a schematic view showing a construction of a fixing device installed with a tubular body for fixing according to an embodiment of the present invention.

Description will be given below of an embodiment of the present invention referring to the figure.

A fixing device shown in FIG. 1 has a construction that a resin film tubular body 2 is circumscribed about a driving fixing roll 1 (a driving member); a press member A having a structure in which an elastic member 32 is mounted on a support 31 and a sheet-like member 33 (a sliding member) covers them is inscribed in the resin film tubular body 2 (a tubular body for fixing) at the circumscribed portion thereof; a nip portion n is formed between the fixing roll 1 and the resin film tubular body 2, wherein a toner image 41 is fixed on a recording medium 4 while the recording medium 4 passes through the nip portion n; a running guide 35 is held on the support 31; a lubricant is provided on a sliding surface of the sheet-like member 33 in sliding contact with the resin film tubular body 2; and project rim-like members (not shown) for controlling a sideways shift of the resin tubular body 2 are provided at both ends of the belt running guide 35.

The fixing roll 1 and the resin film tubular body 2 are heated to a prescribed temperature by respective heat sources 11 and 21 and turn in directions shown by respective arrow marks. A lubricant is provided on the sliding surface of the sheet-like member 33 in sliding contact with the resin film tubular body 2 and the lubricant is fed onto the inner surface of the resin film tubular body 2. The lubricant fed onto the inner surface of the resin film tubular body 2 is carried thereon and further fed onto the sliding surface side of the nip portion. Note that the resin film tubular body 2 may be either supported in a non-hung state or, for example, hung by and supported on plural rolls.

The sheet-like member 33 is made of a non-porous sheet made of a fluorocarbon resin. The term "non-porous" means that there is no pore through which the interior is impregnated with a lubricant and if an oil impregnating amount is used as an index of non-porosity, the oil impregnating amount is in the range of 0.01 $mg/mm^3$ to 0.2 $mg/mm^3$ (preferably, in the range of 0.01 $mg/mm^3$ to 0.15 $mg/mm^3$). Here, the oil impregnating amount is a value obtained in such a way that oil is applied on a sheet, a roll with a sheet wound thereon is rolled on an oily surface of the sheet for 1 minute while pressing the roll to the surface of the sheet with a force of 5 $kg/cm^2$ and then the value is calculated based on a difference between weights of the sheet after the rolling and in a dry state prior to the rolling.

As fluorocarbon resins, there are exemplified: polytetrafluoroethylene resin (PTFE), perfluoropolyvinyl ether resin (PFA) and resins obtained by modifying polytetrafluoroethylene resin (PTFE) or perfluoropolyvinyl ether resin (PFA) (for example, a copolymer of polytetrafluoroethylene and perfluoropolyvinyl ether) from the viewpoint of processibility and frictional characteristics.

Furthermore, as a fluorocarbon resin, also preferably used is modified polytetrafluoroethylene resin (PTFE) obtained by irradiating a fluorocarbon resin with ionizing radiation (for example, an electron beam, a γ ray, a neutron beam, an X ray, a high energy ion beam or the like). Wear resistance and durability of the modified polytetrafluoroethylene resin (PTFE) can be improved, to provide further improved long term stability.

A modified polytetrafluoroethylene resin can be prepared according to a procedure in which PTFE powder available on the market is irradiated with ionizing radiation at a dose in the range of $10^3$ to $10^7$ $m^2 \cdot s^{-2}$ (1 kGy to 10 MGy) in an inert atmosphere at a temperature of 300° C. or higher, then pulverized with a jet mill or the like so as to have a prescribed volume-average particle diameter. The inert atmosphere herein means an atmosphere mainly composed of a rare gas or nitrogen gas. Heating to 300° C. or higher activates a molecular motion of a main chain of a fluorocarbon resin to accelerate a cross-linking reaction between the molecules efficiently. However, overheating adversely causes disconnection and decomposition of a main chain of a molecule. Hence, the heating temperature is preferably in the range of 310° C. to 340° C. in order to suppress such a depoymerization.

The fluorocarbon resins described above may be used either alone or in combination of two or more kinds of them.

A non-porous sheet can be prepared, for example, in the following way: PTFE molding powder (manufactured by Du Pont-Mitusi Fluorochemicals Company, Ltd. with a trade name of Teflon(R) 7-J) is at first put in a prescribed mold to fill the mold, then compression-molded and further baked by being heated to a temperature which is equal to or higher than the melting point, to obtain a molded product. Thereafter, the molded product is skived with a metal cutter into sheets having a prescribed thickness. In the case where a filler is mixed into a sheet, the filler is mixed with and dispersed into the molding powder, followed by a similar process to obtain the sheet. In the case where a sheet is stacked over a substrate on which depressions and protrusions are formed, a method in which an inner surface of the sheet is treated chemically or physically, coated with an adhesive agent, then bonded under compression and heat, or a method in which the sheet is heated to the melting point or higher and then fused to the substrate, can be employed.

A surface roughness depth Rt of a sliding surface of a non-porous sheet, namely, a sheet-like member 33 is preferably in the range of 1.0 μm to 50.0 μm, more preferably in the range of 1.0 μm to 30.0 μm and further more preferably in the range of 1.0 μm to 20.0 μm. If a surface roughness depth Rt is less than 1.0 μm, a lubricant retaining effect sometimes becomes weak, to increase a frictional resistance, while if it is more than 50 μm, depressions and protrusions on the surface sometimes become so large to cause an image defect.

The surface roughness depth Rt is measured according to JIS B 0601 and more specifically, measurement of a surface roughness is performed on a surface of a sheet with a profilometer (manufactured by TOKYO SEIMITSU Co., Ltd. with a trade name of Surfcom).

It is preferable that a non-porous sheet contain a filler for the purpose of imparting a desired surface roughness depth Rt, an electric conductivity, a strength, a lubricity and others to the sheet. As fillers, there are exemplified: lubricative fillers with a lamellar structure made of, for example, molybdenum disulfide, hexagonal boron nitride, mica, graphite, tungsten disulfide and talk; conductive fillers made of carbon black and graphite; and fillers including heat resistant resin (for example, fillers in which the heat resistant resin is selected from an imide resin, an amide resin and an aromatic polyester resin, such as polyimide, a liquid crystal polymer and aramide); and the like.

The fillers are preferably reinforcing fillers that have a needle-shaped, fiber-shaped or tetrapod-shaped structure, from the viewpoint of improving strength of the sheet-like member. Furthermore, the fillers may be used either alone or in combination of two or more kinds from the viewpoint of imparting plural functions to fillers.

An amount of a filler to be added is preferably in the range of 1.0 parts by mass to 30.0 parts by mass, more preferably in the range of 2.0 to 25.0 parts by mass and further more preferably in the range of 5.0 to 20.0 parts by mass with respect to 100 parts by mass of a fluorocarbon resin. If the amount to be added is less than 1.0 part by mass, effects such as imparting conductivity, strength, and lubricity sometimes become weak, while if it is more than 30 parts by mass, occasionally, lubricity, which is characteristic to the fluorocarbon resin, is lowered and surface contamination increases.

A sheet-like member 33 is not limited to a single-layer structure of a non-porous sheet made of a fluorocarbon resin as described above, but may be of a multi-layer structure in which a non-porous sheet is provided on a substrate which substrate has depressions and protrusions on its surface. With the structure in which a non-porous sheet is provided on a substrate which substrate has depressions and protrusions on its surface, a surface profile in conformity with depressions and protrusions on the surface of the substrate reappears on the surface (a sliding surface) of the non-porous sheet. In this way, it becomes possible to impart a surface profile such as the surface roughness depth Rt to the surface of the sliding surface.

As a substrate having such depressions and protrusions on its surface, there is exemplified a porous fiber sheet. As porous fiber sheets, there can be used: a sheet made of a resin having many fine pores, for example a porous sheet obtained by expanding a resin; a porous sheet obtained by stretching a resin in one way or two ways; a sheet obtained by baking molding or the like. Furthermore, there can be used, for example, sheets obtained by making a thin film from fibers woven with porous resin and directly from a porous resin.

Note that a porous fiber sheet constituted by a fabric made of a resin may be used, which fabric is made porous in weaving process, as well as a porous fiber sheet whose fiber itself is porous.

As materials of a porous fiber sheet, it may be properly selected from a polyethylene resin, a fluorocarbon resin and the like. It is preferably PTFE (polytetrafluoroethylene), PFA (tetrafluoroethylene-perfluoroalkylvinyl ether copolymer) and FEP (tetrafluoroethylene-hexafluoropropylene copolymer), all of which are made porous, in consideration of heat resistance, durability and the like. Furthermore, glass fibers, aramide fibers and the like are also preferably used, from the viewpoint of imparting a strength.

Description will be given below of other members used in this embodiment:

As fixing rolls 1 used as a fixing member, no specific limitation is imposed on shape, structure, size and the like, and a fixing roll can be properly selected from rolls themselves publicly known, according to a purpose. The heat fixing roll described above is generally constituted by a cylindrical core, an elastic layer formed on the core, and a heat source inside of the core. Also, a release layer may be provided on a surface of the elastic layer. Providing the release layer is advantageous in that offset of a toner image can be preferably prevented from occurring to ensure an operation of an image fixing device in a stable state.

As materials of the core, no specific limitation is imposed as far as a material has excellent mechanical strength and a good thermal conductivity. And metals such as aluminum, SUS, iron, and copper, alloys thereof, ceramics, FRM, and the like can be cited.

Materials of the elastic layer can be properly selected among publicly known materials, and silicone rubber, fluoro rubber and the like can be cited. Among them, silicone rubber is preferable according to the invention, due to its small surface tension and excellent elasticity. As silicon rubbers, RTV silicon rubber, HTV silicone rubber and the like can be cited, and more specifically, polydimethylsilicone rubber (MQ), methylvinylsilicone rubber (VMQ), methylphenylsilicone rubber (PMQ), fluorosilicone rubber (FVMQ) and the like can be cited.

A thickness of an elastic layer is usually 3 mm or less and preferably 0.5 to 1.5 mm. No specific limitation is imposed on a method for forming an elastic layer on a surface of the core, and, for example, a publicly known coating method can be adopted. As coating methods, kneader coating, bar coating, curtain coating, spin coating, dip coating, and the like can be cited. Among them, dip coating is preferably adopted in the invention.

Materials of a release layer are not particularly limited, and any material can be used as far as it suitably releases from a toner image. Fluoro-rubber, silicone rubber, fluorocarbon resin, and the like can be cited as materials of a release layer. Among them, fluorocarbon resin is particularly preferable. Specific examples of the fluorocarbon resins described above include fluorocarbon resins such as a tetrafluoroethylene-perfluoroalkylvinyl ether copolymer (PFA), a tetrafluoroethylene-perfluoromethylvinyl ether copolymer (MFA), a tetrafluoroethylene-perfluoroethylvinyl ether copolymer (EFA), a polytetrafluoroethylene (PTFE), a tetrafluoroethylene-hexafluoropropylene copolymer (FEP), a polyethylene-tetrafluoroethylene (ETFE), a polyvinylidenefluoride (PVDF), a polychlorotrifluoroethylene (PCTFE), and a polyvinylfluoride (PVF). And a polytetrafluoroethylene (PTFE), a tetrafluoroethylene-perfluoroalkylvinyl ether copolymer (PFA), a tetrafluoroethylene-perfluoromethylvinyl ether copolymer (MFA) and a tetrafluoroethylene-perfluoroethylvinyl ether copolymer (EFA) are especially preferable from the viewpoint of heat resistance, mechanical characteristics and the like.

A thickness of a release layer is usually from 10 to 100 $\mu$m and preferably from 20 to 30 $\mu$m. Methods for forming the release layer on a surface of the core are not limited, and the coating methods described above can be cited. Furthermore, a method in which a tube molded by extrusion molding is coated on the core, can be cited.

Note that a fixing member is not limited to the fixing roll 1, but a fixing member that is arranged in a rotatable manner is properly selected and used, such as fixing members in a form of a roll, a belt, or the like.

The heat sources 11 and 12 are properly selected from heat sources that can heat the nip portion. And it is not limited to those that heat the fixing roll 1 from the inside, but also include those that heat the nip portion through a fixing member such as those that heat the fixing roll 1 from the outside, those that heat the nip portion by heating the resin film tubular body 2 or the press member A, and those that heat the fixing member in the shape of a belt by electromagnetic induction heating.

The shape, the size, and the like of the resin film tubular body 2 are not particularly limited, and a publicly known resin tubular body can be properly selected and used, according to a purpose. As a resin film tubular body 2, generally used is a belt formed in the shape of a band and having no ends thereof. As a structure of the resin film tubular body 2, it may be of either a single-layered structure or of a multi-layered structure. As a resin film tubular body 2 in a multi-layered structure, those each having at least a base layer and a release layer, and the like can be cited.

As materials of the resin film tubular body 2, a thermally curable polyimide, a thermoplastic polyimide, a polyamide, a polyamideimide, and the like can be cited. Among them, a thermally curable polyimide is preferable due to its exellent heat resistance, wear resistance, chemical resistance and the like. Examples of materials of the release layer include fluorocarbon resins such as a perfluoroalkoxyfluorocarbon resin (PFA), a polytetrafluoroethylene (PTFE), a tetrafluoroethylene-hexafluoropropylene copolymer (FEP), a polyethylene-tetrafluoroethylene (ETFE), a polyvinylidenefluoride (PVDF), polychlorotrifluoroethylene (PCTFE), and a polyvinylfluoride (PVF); silicon rubbers such as a polydimethylsilicone rubber (MQ), a methylvinylsilicone rubber (VMQ), a methylphenylsilicone rubber (PMQ), and a fluorosilicone rubber (FVMQ); and fluoro rubbers such as a vinylidenefluoride-type rubber, a tetrafluoroethylene-propylene type rubber, a fluorophosphazenetype rubber, and a tetrafluoroethylene-perfluorovinyl ether.

A press member in which the elastic member 32 is mounted on the support 31 and the sheet-like member 33 covers them, and which is fixed and presses the resin film tubular body 2 toward the fixing roll may be properly selected and as the press member A. From the viewpoint of preventing degradation of the press member A by the heat at fixing, a press member having heat resistance is preferable.

The support 31 is a heat resistant member having a function of holding the elastic member 32, such as a spring. A material of the elastic member 32 of the press member A can be properly selected from publicly known materials according to a purpose. A silicon rubber with a JIS-A hardness in the range of 10 to 40 degrees is preferably used, particularly from the viewpoint of a hardness.

Note that no specific limitation is imposed on the shape, the structure, the size, and the like of the press member A, and they can be properly selected according to a purpose. For example, the press pad may have a structure made of either a single member or plural members having respectively different functions from each other.

What is important about a lubricant is excellency in lubricity, while an index for a lubricity is a kinematic viscosity. And in the case where a lubricant is used in a fixing device, it is necessary to consider a heat resistance, a vaporizing property, and the like of the lubricant. From this viewpoint, a silicone oil is preferable and an amino-modified silicon oil superior in wettability is more preferable. In the case where a lubricant having superior heat resistance is required, a methylphenylsilicone oil is also preferably used. And it is also possible to add a trace amount of an antioxidant into a silicone oil in order to increase heat resistance.

As a lubricant, it is especially desirable to use an amino-modified silicone oil containing an antioxidant. And an amino-modified silicone oil, a dimethylsilicone oil, a mercapto-modified silicon oil, a hindered amine oil, which is an amino-modified silicone oil containing antioxidant, and the like can be used. And it is particularly preferable to use the hindered amine oil having high heat resistance and showing less thermal degradation when used over a long period.

In a mode where a silicone oil is used as a lubricant, a viscosity thereof is preferably in the range of 50 to 3000 cs at ordinary temperature. The lower limit value is determined from the viewpoint of preventing unnecessary vaporization of the silicone oil, while on the other hand, the upper limit value is determined from the viewpoint of preventing the silicone oil from becoming a factor that increase the sliding resistance. Furthermore, in the case where the silicone oil is used at a high temperature, it is most desirable to use a perfluoropolyether oil having excellent heat resistance and stability to heat as the silicone oil.

Furthermore, as a lubricant, a lubricant having higher viscosity than that used in a conventional practice, for example, a grease (for example, a fluoro grease containing a fluoro oil as a base oil, such as Smitec F950 available from Sumico Lubricant Co., Ltd.) because a sheet-like member which does not retain a lubricant is used. Therefore, it is also possible to reduce an amount of a lubricant to be used.

Specific examples of applicable lubricants include a grease, a dimethylsilicone oil, a dimethylsilicone oil to which an organic metal salt is added, a dimethylsilicone oil to which is a hindered amine added, a dimethylsilicone oil to which an organic metal salt and hindered amine are added, a methylphenyl silicon oil, an amino-modified silicon oil to which an organic metal salt is added, an amino-modified silicone oil to which an hindered amine is added, a perfluoropolyether oil and the like.

Note that any of the embodiments described above should not be interpreted as limiting the invention, and any embodiment is within the scope of the invention as far as it satisfies the requirements recited in the invention.

EXAMPLES

The present invention will be explained in detail by way of Examples below, but the invention is not limited by Examples explained below.

Example 1

A J-sheet on which a full-color pattern image was printed by an evaluation apparatus (a color printer C2220 made by Fuji Xerox Co., Ltd.) having a construction similar to a fixing device shown in FIG. 1 was tested. A concrete construction is as follows:

The fixing roll 1 had a structure in which an outer surface of a cylindrical aluminum core having the outer diameter of 30 mm, the wall thickness of 1.8 mm and the length of 360 mm was covered by a silicone HTV rubber (a rubber hardness was 35 degrees in JIS-A) with a thickness of 600 $\mu$m as an elastic layer, a surface of the elastic layer was tubularly covered with tetrafluoroethylene-perfluoroalkylvinyl ether copolymer (PFA) with a thickness of 30 $\mu$m as a release layer, and the surface of the fixing roll 1 was smoothed to a state near mirror. Provided in the core was a halogen lamp with an output of 600 w as a heat source 11. A surface temperature of the fixing roll 1 was controlled at 175° C. with a temperature sensor made of a thermosensitive element arranged in contact with the surface of the fixing roll 1 and a temperature controller not shown.

The resin film tubular body 2 had a structure in which a substrate thereof was a tubular thermocurable polyimide having the circumferential length of 94 mm, the thickness of 75 $\mu$m and the tube length of 320 mm and tetrafluoroethylene-perfluoroalkylvinyl ether copolymer (PFA) had been coated on the outer surface of the substrate to form a release layer having a thickness of 30 $\mu$m.

The press member A comprised: the support 31; the elastic member 32 placed on the support 31; the sheet-like member 33 spanned over a contact surface of the elastic member 32 with the resin film tubular body 2 and the belt running guide 35 provided so that the resin film tubular body 2 was smoothly rotated. The elastic member 32 was made of a silicon rubber having the width of 10 mm, the thickness of 5 mm and the length of 320 mm. And ribs, which were oriented to the belt turning direction, were provided on a surface of the belt running guide 35 so as to reduce the contact area with the inner surface of the resin film tubular body 2. The support 31 was pressed to the fixing roll 1 via the resin film tubular body 2 in the shape of a thin film at a load of 35 kg by the action of a compressed coil spring (not shown).

The contact angle of the resin film tubular body 2 with the fixing roll 1 was about 40 degrees, and a width of the nip portion 16 was about 10 mm. A driving force from a motor was transmitted to the fixing roll 1 to rotate the fixing roll 1 and the resin film tubular body 2 at a rate of 194 mm/sec.

The surface of the press member A was covered by the sheet-like member 33, which was a non-porous fluorocarbon resin sheet (having an oil impregnating amount of 0.015 mg/mm$^3$) made of PTFE resin (molding powder made by Du Pont-Mitsui Fluorochemicals Company, Ltd. with a trade name of Teflon (R)) in the shape of a thin film and a surface roughness Rt of the sheet-like member 33 was 2.0 $\mu$m. And, a methylphenylsilicone oil (manufactured by Shin-Etsu Chemical Co., Ltd. with a trade name of KF 53) as a lubricant was provided between the surface of the sheet-like member 33 and the inner surface of the resin film tubular body 2.

The image fixing device in this state was operated, and a driving torque and a print image quality at the beginning of the printing and at the time when considerable amount of sheets had been printed (when 20,000 sheets had been printed) were checked. As a result, no difference was found between driving torque values measured at the beginning and at the time when considerable amount of sheets had been printed, with extremely good image qualities.

Example 2

An image fixing device was constructed and operated in a condition similar to Example 1 with the exception that a filler containing non-porous fluorocarbon resin sheet (having an oil impregnating amount of 0.03 mg/mm$^3$) prepared by adding boron nitride (boron nitride powder made by Showa Denko K.K. with a trade name of Sho-BN UHP), which was lubricative filler having a layered structure, in an amount of 5% by mass into PTFE resin similar to Example 1 was used as the sheet-like member 33. The image fixing device was operated, and a driving torque and a print image quality at the beginning of the printing and at the time when considerable amount of sheets had been printed were checked. Here, the surface roughness Rt of the sheet-like member 33 was 5.0 $\mu$m. As a result, no difference was found between driving torque values measured at the beginning and at the time when considerable amount of sheets had been printed, with extremely good image qualities.

Example 3

An image fixing device was constructed and operated in a condition similar to Example 1 with the exception that a filler containing non-porous fluorocarbon resin sheet (having an oil impregnating amount of 0.04 mg/mm$^3$) prepared by adding polyimide resin (polyimide powder made by Ube Industries, Ltd. with a trade name of UIP-S), which was heat resistant resin, in an amount of 10% by mass into PTFE resin similar to Example 1 was used as the sheet-like member 33. The image fixing device was operated, and a driving torque and a print image quality at the beginning of the printing and at the time when considerable amount of sheets had been printed were checked. Here, the surface roughness Rt of the sheet-like member 33 was 11.5 $\mu$m. As a result, no difference was found between driving torque values measured at the beginning and at the time when considerable amount of sheets had been printed, with extremely good image qualities.

Example 4

An image fixing device was constructed and operated in a condition similar to Example 1 with the exception that a non-porous fluorocarbon resin sheet (having an oil impregnating amount of 0.05 mg/mm$^3$) prepared by adding graphite (graphite powder made by Nippon Graphite Industries Ltd. with a trade name of ACP), which was a conductive filler, in an amount of 15 parts by mass (with respect to 100 part by mass of PTEF resin) into PTFE resin similar to Example 1 was used as the sheet-like member 33. The image fixing device was operated, and a driving torque and a print image quality at the beginning of the printing and at the time when considerable amount of sheets had been printed were checked. Here, the surface roughness Rt of the sheet-like member 33 was 18.0 $\mu$m. As a result, no difference was found between driving torque values measured at the beginning and at the time when considerable amount of sheets had been printed, with extremely good image qualities.

Example 5

An image fixing device was constructed and operated in a condition similar to Example 1 with the exception that a non-porous fluorocarbon resin sheet (having an oil impregnating amount of 0.06 mg/mm$^3$) prepared by adding zinc oxide whisker (zinc oxide powder made by Matsushita Amtec Co., Ltd. with a trade name of Panatetra WZ-0501), which was a reinforcing filler, in an amount of 10 parts by mass (with respect to 100 part by mass of PTEF resin) into PTFE resin similar to Example 1 was used as the sheet-like member 33. The image fixing device was operated, and a driving torque and a print image quality at the beginning of the printing and at the time when considerable amount of sheets had been printed were checked. Here, the surface roughness Rt of the sheet-like member 33 was 15.0 $\mu$m. As a result, no difference was found between driving torque values measured at the beginning and at the time when considerable amount of sheets had been printed, with extremely good image qualities.

Example 6

Example of PTFE Modified with Energy Beam

An image fixing device was constructed and operated in a condition similar to Example 1 with the exception that a PTFE resin (having an oil impregnating amount of 0.12 mg/mm$^3$) including cross-linked PTFE powder (manufactured by Hitach Cable, Ltd. with a trade name of XF-1A) was used as the sheet-like member 33. The image fixing device was operated, and a driving torque and a print image quality at the beginning of the printing and at the time when considerable amount of sheets had been printed were checked. Here, the surface roughness Rt of the sheet-like member 33 was 2.0 $\mu$m. As a result, no difference was found between driving torque values measured at the beginning and at the time when considerable amount of sheets had been printed, with extremely good image qualities.

Example 7

Example of Embodiment in which Non-Porous Fluorocarbon Resin Sheet is Provided on Substrate Having Depressions and Protrusions on Surface Thereof An image fixing device was constructed and operated in a condition similar to Example 1 with the exception that a sheet (having an oil impregnating amount of 0.070 mg/mm$^3$) having a structure in which a non-porous fluorocarbon resin sheet made of a modified PTEF resin was fusion welded on the thermo-compression onto a glass cloth (manufactured by Arisawa Mgt. Co., Ltd.) was used as the sheet-like member 33. The image fixing device was operated, and a driving torque and a print image quality at the beginning of the printing and at the time when considerable amount of sheets had been printed were checked. Here, the surface roughness Rt of the sheet-like member 33 was 2.8 $\mu$m. As a result, no difference was found between driving torque values measured at the beginning and at the time when considerable amount of sheets had been printed, with extremely good image qualities.

Comparative Example 1

An image fixing device was constructed and operated in a condition similar to Example 1 with the exception that a porous sheet (having an oil impregnating amount of 0.21 mg/mm$^3$ and a surface roughness Rt of 5.9 $\mu$m) prepared by impregnating glass fibers with fluorocarbon resin was used as the sheet-like member 33. The image fixing device was operated, and a driving torque and a print image quality at the beginning of the printing and at the time when considerable amount of sheets had been printed were checked. As a result, while an image quality was good at the beginning of the printing, a large image irregularity and paper wrinkle were observed at the time when considerable amount of sheets had been printed. Furthermore, while a driving torque was low at the beginning of the printing, it increases with the passage of printing time. In addition, when a surface of the sheet was observed, the fluorocarbon resin on the surface was worn out to expose glass fibers.

As described above, according to the invention, there can be provided, as a sliding member, a non-porous sheet including fluorocarbon resin capable of enduring the usage over a long term and having excellent heat resistant stability and low friction characteristics, and further provided an image fixing device using the non-porous sheet that realizes stable running of a belt.

Furthermore, since an addition of a filler into a non-porous sheet at a proper content enables simultaneous impartment of a desired surface roughness depth Rt and better characteristics of conductivity, a strength, a lubricity and the like, a fixing device can be provided which has a higher reliability when used for a long period.

What is claimed is:

1. A sliding member for an electrophotographic apparatus, in which at least a sliding surface thereof is made of a non-porous sheet including a fluorocarbon resin, wherein a surface roughness depth Rt of the sliding surface is in a range of 1.0 $\mu$m to 50.0 $\mu$m.

2. A sliding member for an electrophotographic apparatus according to claim 1, wherein the fluorocarbon resin is selected from the group consisting of polytetrafluoroethylene (PTFE), perfluoroalkoxy resin (PFA), and modified resins thereof.

3. A sliding member for an electrophotograhic apparatus according to claim 1, wherein the fluorocarbon resin is a modified polytetrafluoroethylene resin (PTFE) obtained by irradiating a fluorocarbon resin with ionizing radiation.

4. A sliding member for an electrophotograhic apparatus according to claim 1, wherein a filler is contained in the non-porous sheet.

5. A sliding member for an electrophotograhic apparatus according to claim 1, wherein a filler is contained in the non-porous sheet.

6. A sliding member for an electrophotograhic apparatus according to claim 2, wherein a filler is contained in the non-porous sheet.

7. A sliding member for an electrophotograhic apparatus according to claim 3, wherein a filler is contained in the non-porous sheet.

8. A sliding member for an electrophotographic apparatus according to claim 4, wherein the filler is a lubricative filler having a layered structure.

9. A sliding member for an electrophotographic apparatus according to claim 4, wherein the filler is a conductive filler.

10. A sliding member for an electrophotographic apparatus according to claim 4, wherein the filler includes a heat resistant resin selected from the group consisting of an imide-type resin, an amide-type resin and an aromatic polyester-type resin.

11. A sliding member for an electrophotographic apparatus according to claim 4, wherein the filler is a reinforcing filler having a needle-shaped, fiber-shaped or tetrapod-shaped structure.

12. A sliding member for an electrophotographic apparatus according to claim 4, wherein the filler includes at least two kinds of fillers.

13. A sliding member for an electrophotographic apparatus according to claim 4, wherein an amount of the filler to be added is in a range of 1.0 part by mass to 30 parts by mass with respect to 100 parts by mass of the fluorocarbon resin.

14. A sliding member for an electrophotographic apparatus according to claim 1, wherein the non-porous sheet is provided on a substrate which has depressions and protrusions on a surface thereof.

15. A fixing device comprising:

a driving member;

a tubular body for fixing, which is pressed to the driving member so that the tubular body can be driven to rotate by the driving member, a recording medium on which an unfixed toner image is formed being sandwiched between the tubular body and the driving member at a nip portion formed between the tubular body and the driving member, a press member disposed inside the tubular body that presses the tubular body toward the driving member;

a sheet-shaped member interposed between the tubular body and the press member;

a lubricant provided between the tubular body and the sheet-like member; and a heat source for heating the nip portion, wherein the sheet-shaped member is a sliding member for an electrophotographic apparatus in which at least a sliding surface of the sliding member is made of a non-porous sheet including a fluorocarbon resin.

16. A fixing device according to claim 15, wherein the lubricant is selected from the group consisting of a synthetic lubricating oil grease, a dimethylsilicone oil, dimethylsilicone oil to which an organic metal salt is added, dimethylsilicone oil to which a hindered amine is added, dimethylsilicone oil to which an organic metal salt and hindered amine are added, a methylphenylsilicone oil, amino-modified silicone oil to which an organic metal salt is added, amino-modified silicone oil to which a hindered amine is added, a perfluoropolyether oil and a modified perfluoropolyether oil.

* * * * *